United States Patent [19]

Svidunovich et al.

[11] Patent Number: 4,855,105

[45] Date of Patent: Aug. 8, 1989

[54] WEAR-RESISTANT STEEL

[75] Inventors: Nikolai A. Svidunovich, Minsk; Leonid I. Parfenov, Moscow; Alexandr I. Garost, Minsk; Gennady A. Sorokin, Vostochno-Kazakhstanskaya; Viktor N. Volkov, Vostochno-Kazakhstanskaya; Viktor A. Obiedkov, Vostochno-Kazakhstanskaya; Valery K. Karbanovich, Minsk; Vladimir V. Vashkevich, Minsk; Alexandr N. Verbitsky, Minsk, all of U.S.S.R.

[73] Assignee: Belorussky Tekhnologichesky Institut Imeni S.M. Kirova, U.S.S.R.

[21] Appl. No.: 92,676

[22] Filed: Sep. 3, 1987

[51] Int. Cl.[4] ..... C22C 38/04; C22C 39/30

[52] U.S. Cl. ..... 420/75; 420/72; 420/83; 420/120; 420/128

[58] Field of Search ..... 420/72, 120, 75, 83, 420/128

[56] References Cited

U.S. PATENT DOCUMENTS

| | | | |
|---|---|---|---|
| 4,531,974 | 7/1985 | Kos | 420/72 |

FOREIGN PATENT DOCUMENTS

| | | | |
|---|---|---|---|
| 0100122 | 9/1978 | Japan | 420/72 |
| 0263163 | 11/1970 | U.S.S.R. | 420/72 |
| 0449985 | 11/1974 | U.S.S.R. | 420/72 |
| 0657078 | 4/1979 | U.S.S.R. | 420/72 |
| 0908910 | 2/1982 | U.S.S.R. | 420/72 |
| 1187023 | 4/1970 | United Kingdom | 420/72 |

*Primary Examiner*—Upendra Roy

*Attorney, Agent, or Firm*—Ladas & Parry

[57] ABSTRACT

A wear-resistant steel contains carbon, manganese, silicon, sulphur, phosphorus, nitrogen, titanium, and iron with the following proportions of these components in weight %:

| | |
|---|---|
| Carbon | 0.4–1.3 |
| Manganese | 3–11.5 |
| Sulphur | up to 0.5. |
| Phosphorus | up to 0.1 |
| Titanium | 0.01–0.15 |
| Nitrogen | 0.02–0.9 |
| Iron | the balance. |

3 Claims, No Drawings

WEAR-RESISTANT STEEL

FIELD OF THE ART

The present invention relates to foundry practice and more specifically to a composition of wearresisting steel and a method of its production.

The present invention can be most efficiently used for production of high-manganese steel castings to be employed under impact-abrasive load as well as in mining and extractive industry, for transport means, for example, as teeth of excavating machine buckets, wear plates of cone and jaw crushers, dredge buckets, crawler tracks and other similar parts.

PRIOR ART

The continuous development of industry, and, in particular, ferrous and non-ferrous metallurgy demands an ever increasing use of articles, working under hard impact-abrasion conditions, where high-manganese steels are found to be among the best. Combination of high strength, density and plasticity together with capability of this steel to increase several times the surface hardness under impact load, as well as relative simplicity and cheapness of its production, ensured its wide use.

Several millions of high-manganese steel castings are produced annually all over the world.

Exhausting of ore reserves and, in particular, manganese ones causes a trend to use steel with a lower content of alloying elements. As high manganese steel contains 12–15% of manganese and for its production hundreds of thousands tons of ferromanganese are consumed, a search for new steels with a lower manganese content and methods of its commercial production without deteriorating the operational characteristics of steel castings is an important and urgent problem.

One of the most promising ways of solving this problem is to replace a part of manganese with nitrogene. Structure of cast high manganese steel of usual composition after quenching is purely austenitic due to the presence of manganese and carbon, which are the elements stabilizing this structure at room and low temperatures. The presence of nitrogen in an alloy promotes forming of austenitic structure, i.e. nitrogen is an austenizator. Furthermore, nitrogen is dozens times more active austenizator than manganese. About 0.1% of nitrogen gives the same stabilizing effect to an austenitic structrue as 3–6% of manganese. Besides, nitrogen austenite is more stable as compared to manganese one at all temperatures from high, what is very essential for crawler tracks and similar parts, up to low temperatures, what is important for machines and equipment employed in north conditions. The wear resistance of high-manganese steel with nitrogen additions increases. The specific effect in increasing the wear resistance can be achieved by the combined addition to steel of nitrogen and one or several effective nitride-forming elements (for example, Ti, V, Cr), which, forming the required nitrides promote improvements in the physico-mechanical properties of steel as well as the general conditions for forming the structure of a casting.

In the present state of the art the most amount of wear-resisting steels of high manganese content is produced by melting in basic electric furnaces. About 90% of such steels is produced by this process. A method of mixing components, when plain steel is melt in an acidic or basic electric arc furnace, an open-hearth furnace or a converter, and an alloying additive is melted in another melting unit with subsequent mixing of the both melts in a casting ladle, finds only a limited application.

However, with the available number of existing electric-arc furnaces, in which the most quantity of high-manganese steel is produced, commercial alloying of steel with nitrogen will involve great difficulties.

At present the main method of alloying steel with nitrogen is melting of nitrogen ferroalloys produced by solid phase nitriding. Their production is labour-consuming and is carried out in many stages, that is why they are usually much more expensive than corresponding conventional ferroalloys. Another reason is specific requirements to the quality of raw materials to be nitrided, and, in particular, the preferable use of low-carbon materials. One of the cheapest and easily produced ferroalloys is carbon ferromanganese, which is rather widely used for production of high-manganese steel. The production of nitrogen-containing carbon ferromanganese is very limited.

In an electric-arc furnace nitrogen assimilation by ferroalloys nitrided in solid state is unstable and does not exceed 50–70%.

At present, due to increasing consumption of materials containing nitrogen, methods of nitriding corresponding alloying additive melts are developed, and, in particular, those with the use of low-temperature plasma.

Nitrogen, activated in low-temperature plasma, is quickly and efficiently absorbed by the melt. Saturation of melts with nitrogen is usually carried out in plasma furnaces. However, nowadays, power and life of plasma generators using nitrogen as a plasma-forming gas are limited, and to provide for sufficient-scale production it is necessary to replace dozens of available electric-arc furnaces with plasma ones, nowadays this being only a remote prospect and not profitable.

At present a large number of compositions of wear-resistant steels are known. One of such steels comprises 0.7–1.2% of carbon, 5.0–15.0% of manganese, 0.3–0.8% of silicon, 0.1–0.5% of aluminium, 0.05–0.3% of nitrogen, 0.1–0.5% of titanium, to 0.05% of sulphur, to 0.01% of phosphorus, the balance being iron. This steel, however, features an inadmissibly high upper percentage level of scarce manganese (15%) and other alloying additives (titanium, aluminium) which fail to bring about appreciable improvements in the properties of steel. Investigations demonstrate that the introducing of more than 10% of manganese does not bring about an enhancement in the wear resistance of the given steel. The minimal level of manganese content should be such as to ensure the formation of austenitic structure which, in the case of an increased nitrogen content, can be obtained, as is known, if the manganese content is lowered.

Titanium content exceeding 0.1% in the steel does not improve its mechanical properties. A small amount of titanium (0.3–0.1%) increases the ultimate strength and relative contraction approximately by 10%.

A matter of common knowledge is the composition of a wear-resistant steel, comprising, in weight %: carbon, 1.0–1.5; manganese, 11.0–15.0; silicon, 0.3–0.1; chromium, 0.6–1.5; titanium, 0.03–0.07; cerium, 0.02–0.05; sulphur, to 0.04; phosphorus, to 0.07; iron, the balance.

This steel features an inadmissibly high percentage of scarce manganese (15%). The presence of chromium in the steel has no influence on its liability to cold hardening, i.e. the maximal hardness of the steel containing chromium and containing no chromium is the same after cold deformation by impacts in case the steel structure prior to the cold hardening is purely austenitic. The presence of chromium sometimes leads to the appearance of cracks because of elevated internal stresses associated with the liberation of carbides. In addition, investigations showed that an increase of cerium content in this steel to 0.08% would contribute to a still more efficient reduction of the grain size and to a better cold harden-ability of the steel in the course of service of ingots, this increasing the wear resistance of parts.

Known in the art is a wear-resistant steel, featuring an enhanced resistance to abrasive wear and containing a smaller amount of manganese. This steel has the following composition, in weight %: carbon, 0.7–1.0; manganese, 4.0–9.0; silicon, 0.2–1.0; titanium, 0.03–0.15; nitrogen, 0.08–1.0; sulphur, to 0.05; phosphorus, to 0.1; iron, the balance.

The mechanical properties of said steel are as follows: ultimate strength, 85–110 kg/mm$^2$; limit of stretching strain, 55–65 kg/mm$^2$; impact viscosity, 30–40 kg m/cm$^2$; Brinell hardness, 240–270. The known steel, however, contains more than 0.1% of titanium, which leads to the formation of a large quantity of coarse carbonitride inclusions, whose distribution in the grain is nonuniform and which accumulate, mainly, at the grain boundary. Nitrogen content in the known steel is very high (to 1%). To introduce such an amount, it is necessary to increase appreciably the pressure of nitrogen in the melting chamber in the course of plasma-arc remelting, and to carry out the crystallization of metal under the same pressure to preclude the formation of nitrogen gas blisters. Studies have shown that the introducing of more than 0.6% of nitrogen does not add to the water resistance of castings. High mechanical characteristics and wear resistance can be attained at lower concentrations of nitrogen (less than 0.08%).

The above-considered steel, however, has inadequate mechanical properties and low wear resistance due to poor cold hardenability of castings in the course of impact-abrasive wear.

Known in the art is a method of making steel, residing in that first non-alloyed basic steel of a required composition is smelted in a furnace. Then the entire mass of the solid alloying additive comprising organic nitrogen-containing compounds such as calcium cyanamide in pure form or in combination with ferroalloys and fluxing additives is added to the resulting basic steel. The above-cited additives are introduced into the steel pouring ladle 20–150 s after the commencement of the melt tapping from the furnace.

The degree and stability of nitrogen assimilation in the known method are not high due to the fact that the solid alloying additive decomposes in the reaction with molten metal, the additive decomposition being intensive and accompanied by the evolution of gaseous reaction products. These gaseous products tend to leave the melt as large bubble rather than be dissolved in the melt. The degree of nitrogen assimilation should be understood as the ratio of the part of gaseous nitrogen dissolved in the melt to the overall nitrogen content in the solid alloying additive. The stability of nitrogen assimilation characterizes the deviation of nitrogen content from its average value in steel in different heats with the process parameters remaining constant.

The making of water-resistant high-quality steel by using the above prior art method involves difficulties due to the instability of nitrogen assimilation from the solid alloying additive, complexity of carrying out final reduction, this materially affecting the quality of the wear-resistant steel.

Furthermore, the steel of a required composition proves to contain such undesirable admixtures as oxygen, sulphur, phosphorus, which impair the surface properties of the steel; these undesirable admixtures get into the steel from the solid alloying additive together with nitrogen.

The known method has not found extensive application because of toxicity of the alloying additive components, e.g. calcium cyanamide and gaseous products of the decomposition reaction. This requires additional measures to be taken for protecting the service personnel and precluding contamination of the environment. The implementation of the method thus becomes considerably more complicated and costly.

To ensure complete assimilation of nitrogen, a method of alloying steel with nitrogen was developed. This method comprises preparation of a non-alloyed basic steel in one melting unit, the resulting melt containing carbon in an amount of from about 0.1 to about 1.4 mass %. An alloying additive containing mainly manganese and nitrogen-binding elements, such as chromium, titanium, vanadium, aluminium, is melted in another melting unit. Then the metal alloying additive is saturated with nitrogen to its content in the molten additive of 0.01–0.7%. Then both melts are blended and their combination gives the steel of the required composition.

Nevertheless, the resulting wear-resistant steel has a large-grained structure with individual coarse inclusions, e.g. of carbides of nitrides at the boundaries of austenitic grains, this impairing the physico-mechanical properties of the steel, including its liability to cold hardening under the effect of impact loads.

This can be explained by the fact that the weight ratio of the non-alloyed basic steel and the alloying additive for the high-manganese wear-resistant steel ranges from 1:5 to 1:10 and less. The resulting maximum concentration of nitrogen in the finished steel does not exceed 0.00715–0.014%, respectively.

Such a content of nitrogen has no material effect on the strengthing and stabilization of the austenitic structure.

Therefore, making of a wear-resistant steel with a reduced content of manganese by the known method proves to be out of the question, since this will lead to the appearance of new structural components in the steel, e.g. pearlite and ferrite, which add to the steel brittleness and diminish its wear resistance.

Moreover, the microstructure of the wear-resistant steel produced by the above method will be characterized by the presence of uniformly distributed fine-dispersed nitrides, mainly as a result of low nitrogen content in the alloying additive.

An increase of nitrogen content in the alloying additive will create conditions for coarsening of the individual nitrides and for the corresponding growth of the grain size. This will tell negatively on the plastic properties and wear-resistance of the castings obtained.

Furthermore, the known method does not allow intensification of the smelting process and the process of nitriding the alloying additive because of a low rate of melt saturation with nitrogen. The latter factor adds to the time required for bringing the method into effect, its productivity being thus limited.

SUMMARY OF THE INVENTION

It is an object of the invention to provide a wear-resistant steel with a reduced content of manganese, while retaining its physico-mechanical and service characteristics.

Another object of the invention is to intensify the method of producing wear-resistant steel.

Still another object of the invention is to improve the productivity of the method of producing wear-resistant steel.

Yet another object of the invention is to cut down the prime cost of producing wear-resistant steel and to broaden the scale of its production.

In accordance with said and other objects the essence of the present invention resides in that in a wear-resistant steel containing carbon, manganese, silicon, sulphur, phosphorus, nitrogen, titanium, iron, according to the present invention contains the above said components in the following proportions, in weight percent:

| | |
|---|---|
| carbon | 0.4–1.3 |
| manganese | 3–11.5 |
| silicon | 0.1–1.0 |
| sulphur | up to 0.05. |
| phosphorus | up to 0.1 |
| titanium | 0.01–0.15 |
| nitrogen | 0.02–0.9 |
| iron | the balance. |

Said composition provides for a pure austenitic structure, while the manganese content in steel is lower.

As nitrogen is much more active than carbon as an element promoting to steel age hardening, capability to hardening of high-resisting steel, according to the present invention, being better with an increase in the content of carbon dissolved in the Fe-$\gamma$ lattice, becomes still better, when contains nitrogen. This improves wear resistance of steel. The higher nitrogen content makes steel nearer to eutectoid one at a comparatively low carbon content in it, which, in its turn, greatly simplifies steel heat treatment because there are much less carbides in cast steel structure.

Thus, the proposed steel composition provides for higher operational characteristics of castings under impact-abrasion load.

It is expedient to add complementarily cerium in an amount of 0.0057–0.0839% by weight to the proposed steel. We recommend wear-resisting steel of the following content, percent by mass: carbon 0.4–1; manganese 4–10; silicon 0.2–1; titanium 0.03–0.1; nitrogen 0.02–0.6; cerium 0.005–0.08; iron - the balance. Steel may contain inclusions; percent by mass: sulphur up to 0.05; phosphorus up to 0.1.

Supplementary addition of cerium (Ce) and modification of component content promoted an increase in the wear-resisting steel strength.

Titanium and nitrogen form finely dispersed titanium nitrides which are uniformly distributed inside the austenitic grain after thermal treatment. At the initial stage of steel crystallization its centres are titanium nitrides. At the same time cerium and nitrogen dissolved and not combined in nitrides are present in liquid melt, and, being surface-active elements, influence efficiently the growth of austenitic grains in a liquid state. At temperatures of 800°–900° C. cerium promotes forming with dissolved nitrogen finely-dispersed cerium nitrides and carbonitrides. Their formation takes place due to oversaturation of the solid solution with carbon, nitrogen and cerium. Spontaneous enrichment of defects in the crystal lattice with dissolved atoms results in formation of balanced segregations. Finely-dispersed cerium nitrides and carbonitrides formed during cooling in the places of segregation formation with a higher concentration of carbon, nitrogen and cerium together with titanium nitrides formed earlier promote efficient hardening of steel. Steel modified with titanium, cerium and nitrogen is characterized by fine-grain structure, extremely fine and pure grain boundaries and the presence of large quantities of nitrides and carbonitrides, uniformly distributed in the base of the austenitic grains. Such a structure provides for higher resistance to impact-abrasion wear, improves the strength and hardening of castings during their use.

The essence of the present invention also resides in that in the method of production of wear-resisting steel, which includes melting of plain steel with carbon content in the melt from about 0.1 to about 1.4% by weight and melting of an alloying additive, containing mainly manganese and elements combining with nitrogen, followed by saturation with nitrogen of the alloying additive being melted, subsequent mixing of the both melts and obtaining, as a result, steel of the required content, according to the invention, the saturation of the alloying additive melt with nitrogen is carried out through its treatment with low-temperature plasma formed of a gas containing nitrogen at a nitrogen partial pressure in it from about 0.08 to about 0.3 MPa, and for mixing of the melts first to the plain steel melt taken in an amount up to about 0.7 weight of its total melt is added the total mass of the melt of the alloying addition saturated with nitrogen and later the rest of the plain steel melt is added therein.

Such accomplishment of the wear-resisting steel production method provides for higher content of nitrogen in the ready steel melt. During crystallization of this steel in natural environment conditions blow-holes and pores do not appear because nitrogen is present in steel as bonded in nitrides and in a solid solution form.

Natural conditions imply solidification at the temperature +20° C. in air at normal atmospheric pressure, approximately corresponding to nitrogen partial pressure of 0.08 MPa. This permits improving significantly the austenitic structure and physico-mechanical characteristics of wear-resisting steel. Measures taken to eliminate blow-hole formation diminish the danger of producing poor-quality articles and permits to ease requirements to the process control.

Exposure of the alloying additive melt to low-temperature plasma containing nitrogen, formed of a nitrogen-containing gas at a partial pressure of nitrogen in it from about 0.08 to about 0.3 MPa provides for optimal conditions for its efficient and quick saturation with nitrogen.

This is attained because a higher partial pressure of nitrogen in the melting unit with the alloying additive melt intensifies the process of saturation of the melt with nitrogen due to an increase of the gas/melt, interface surface, active agitation of the both and maximum dissociation and ionization of nitrogen.

Treatment of the alloying additive is carried out at a nitrogen partial pressure in low-temperature plasma of about 0.08 to about 0.3 MPa because this is an optimum pressure range from the point of view of the process simplicity and speed of saturation with nitrogen. Pressure of 0.08 MPa corresponds to a partial pressure of nitrogen in open air under atmospheric pressure, that is why no specific equipment is necessary to create it. Such pressure value is mostly preferable and efficient.

Increasing nitrogen partial pressure up to 0.3 MPa results in increasing the speed of saturation of the alloying additive and enlarging nitrogen concentration in the melt several fold. This pressure can be attained by using simple techniques. A further increase in the pressure imposes higher requirements on the melting unit to be used, while the speed of saturation of the melt with nitrogen and its concentration in the melt increases only a little. Thus, increasing the nitrogen partial pressure over 0.3 MPa is not desirable for technical and economic considerations.

Accomplishment of the mixing process in several stages permits to avoid nitrogen loss from the alloying additive melt, especially when its content is higher than its maximum concentration in the atmosphere. Introduction of the alloying additive partly saturated with nitrogen to a ladle partly filled with plain steel melt is done to reduce the total nitrogen concentration of the resulting mixture of the melts to values at which emission of nitrogen from the melt does not occur.

Restriction of the plain steel mass first poured into a ladle to about 0.7 of the total melt mass is conditioned by not high degree of stirring arizing upon addition of the total mass of the alloying additive to a large mass of the plain steel melt. The subsequent introduction of the rest mass of the melted plain steel provokes the required stirring which provides for rapid equalizing of the chemical composition through the whole ladle volume. This eliminates the necessity of holding steel in a ladle before tapping and favourably tells on the metal quality and speed of the accomplishment of the process.

If nitrogen content in the alloying additive does not include nitrogen emission under atmospheric conditions there is no necessity in the preliminary filling the ladle with the plain steel melt, so that whole mass of the alloying additive melt saturated with nitrogen is poured into the ladle and then the whole mass of the plain steel melt is added thereinto.

It is expedient to introduce a part of elements forming nitrides during saturation with nitrogen of the alloying additive being melted, and to introduce the rest part of elements forming nitrides while mixing the melts.

As a nitride-forming element it is necessary to use cerium.

We recommend to determine the portion of nitride-forming elements to be introduced into the alloying additive saturated with nitrogen, using the following relationship:

$$\sum_{i=1}^{n} \frac{m_i}{[Me_i]} = \sum_{i=1}^{n} \left(1 + 283 \frac{\beta^* \delta}{\sqrt{P_{N2}}} \cdot K^i \alpha_N{}^i\right),$$

where $m_i$ - amount of the i-alloying element to be added, %:

$[M_{ei}]$ - total amount of i-alloying element according to the chemical composition, %;

$P_{N2}$ - partial nitrogen pressure in a plasma-forming gas, Pa;

$\rho^*$ - coefficient of mass-transfer intensity (from about 0.5 to about 3);

$\delta$ - criterion of oversaturation with nitrogen;

$K^i$ - factor of assimilation of i-alloying element (usually 0.8–1);

$\alpha_N$ - parameter of interaction in liquid melts Mn-N-i at temperature of tapping.

To produce steel of a high nitrogen content with nitride and carbonitride inclusions of minimum size, formed during the interaction of nitrogen with nitride-forming elements, it is necessary to introduce these elements into the alloying additive melt in portions.

Such nitrides present in the alloying additive melt in the form of solid particles will serve as crystallization centres during solidification of a casting and promote reducing of the grain size in the microstructure obtained. The presence of the ready crystallization centres in the solidifying steel decreases the zone of loose equiaxial crystals and diminishes the tendency to transcrystallization. This improves the operational properties of castings as a whole.

The second portion of the nitride-forming elements introduced at the time of mixing of the alloying additive melt with the plain steel melt serves to avoid formation of nitride holes in the ready steel melt. This portion of the nitride-forming elements interacts with nitrogen trying, to escape from the melt and combine with it, preventing thereby formation of blow-holes in castings. This creates conditions for obtaining wear-resisting steel of a high nitrogen content. It is proved by experiments that steel of a higher wear-resistance is produced if a portion of nitride-forming elements to be introduced in the alloying additive melt saturated with nitrogen is determined with the help of relationship (1). This relationship depends on the used partial pressure of nitrogen in a plasma-forming gas, degree of mass-transfer intensity in the unit used for melting the alloying additive, ratio of the required concentration of nitrogen in the alloying additive to nitrogen concentration obtained under atmospheric conditions, factor of assimilation of a given element, which is a standard ferroalloy, at the time of its introduction onto the melt, parameter of interaction between the nitride-forming element and nitrogen in the liquid melts of manganese-nitrogen the added nitride-forming element at a temperature of tapping.

Coefficient $\rho^*$ of mass-transfer intensity in a melting means the ratio of average speed of nitrogen assimilation by the melt during its nitriding in a certain melting unit to the same speed in a standard melting unit. By a standard unit is meant a plasma-induction furnace of 160 kg capacity with an average nitrogen saturation speed in % by mass, about 0.01% min. Both methods of determining the mass-transfer intensity, by calculation or by experiment, are permissible.

Factor $K^i$ of assimilation of a nitride-forming element means a ratio of its mass in the ready steel determined by standard chemical analysis methods to the mass of the nitride-forming element in the initial ferroalloy.

By parameter $\alpha_n{}^i$ of interaction between a nitride-forming element and nitrogen in liquid melts manganese-nitrogen- an added nitride-forming element at a temperature of metal pouring out is means a value determined by the following relationship:

$$\alpha_N{}^i = \frac{\partial \ln f_i}{\partial [C_i]} \text{ at } [C_i] \to 0,$$

where $f_i$ - factor of nitrogen activity in the melt, determined in a traditional way;

$[C_i]$ - concentration of the added element, %.

By the temperature of metal pouring out is meant an average temperature of the ready steel melt at the beginning of pouring from a ladle into a mould. It is taken equal to 1450° C.

Such addition of the nitride-forming elements permits a large quantity of finely-dispersed nitrides and carbonitrides to be formed in the melt what provides for production of metal of high quality and fine grain structure with location of the most nitrides and carbonitrides inside of grains. The presence of such very hard particles inside the grains promotes steel capability to cold hardening and provides for high hardness of the hardened layers, what significantly increases resistance of castings to impact-abrasion wear. Relative quantity of undesirable zones of structure, such as zones of equiaxial and columnar crystals is decreased, and this improves the operational characteristics of castings.

It is preferable to introduce a portion of the nitride-forming elements into the alloying additive being saturated with nitrogen after preliminary fine grinding into particles of about 1 up to about 4 mm.

This is stipulated by the fact that the melting temperature of many nitride-forming elements, for example, titanium, is substantially higher than the melting temperature of the alloying additive melt, containing mainly manganese. Therefore, it is necessary during dissolving the nitride-forming elements in the alloying addition melt to increase its temperature and enlarge the time of the alloying addition preparation. These factors increase energy consumption and prolong the process, as well as deteriorate the conditions of absorbing nitrogen by the alloying additive.

The use of preliminarily ground nitride-forming elements permits to eliminate the above said drawbacks, i.e. it reduces energy consumption and time of the process, improves the absorbtion of nitrogen by the alloying additive. Besides, the presence of solid particles of the nitride elements in low-temperature nitrogen-containing plasma creates the conditions for formation of the corresponding nitrides already in low-temperature plasma with speeds several order higher than in the melt. Nitrides, being additionally formed in low-temperature plasma are characterized by fine dispersity, ultradispersity and many other properties favourably distinguishing them from nitrides formed in the melt. In particular, their higher surface energy improves the process of crystallization which occurs with their participation and promotes extremely strong bonding of the nitride particle with the metal around it. These advantages improve the physico-mechanical and operational properties of steel produced.

Particles of a size less than about 1 mm are completely evaporated in low-temperature plasma and do not get into the melt. Particles of size more than 4 mm to not have enough time to be melted through their whole depth during their residence in the low-temperature plasma: they come into the melt in semisolid state which results in formation of coarse inclusions in the structure, the latter greatly deteriorating the physico-mechanical properties of steel.

DETAILED DESCRIPTION OF THE INVENTION

Other objects and advantages of the invention will be more apparent from the following examples of its embodiment.

EXAMPLE 1

Plain steel is being melted in an electric-arc furnace of 5-t capacity during 100 minutes until the melt of a certain chemical composition (see Table 1) is obtained. At the same time an alloying additive of the chemical composition shown in Table 1 and mainly of manganese is being melted in a plasma-induction furnace of 1 t capacity. Then the alloying additive being melted in saturated with nitrogen through treatment by low-temperature plasma formed of a nitrogen-containing gas with nitrogen partial pressure in it about 0.08 MPa, for example, by a plasma arc of 200–300 kW, glowing between the plasma generator electrode and the melt. The partial pressure of nitrogen is maintained at such value that nitrogen content in the melt is of the desired level. If it is necessary to accelerate the process of the melt saturation with nitrogen, the partial pressure in the melting unit is increased up to 0.3 MPa and later decreased to the required value. After that the both melts, viz. the plain steel and the alloyed additive, saturated with nitrogen, mixed in a ladle. To this end, from about 0 up to 0.7 of the melt mass is poured into the ladle and after that the total mass of the alloying additive melt saturated with nitrogen is added into it. Then, the rest of the melted plain steel is introduced into the obtained melted mixture in the ladle. The optimum mass of the plain steel which is taken at the first stage of the process is determined by a difference between the maximum nitrogen content in the alloying additive at atmospheric pressure and nitrogen content required to obtain the desired nitrogen content in the ready steel.

If this difference is positive there is no necessity in preliminary pouring the plain steel into the ladle. The more negative said difference, the greater quantity of the plain steel should be preliminarily poured into the ladle. In this case the maximum nitrogen content in the alloying additive at atmospheric pressure is higher than required for the desired nitrogen concentration in the ready steel. That is why mixing is done as follows: the total mass of the alloying additive melt saturated with nitrogen is poured into the ladle and the total mass of the melted plain steel is added to it. As a result, steel of the required composition, shown in Table 1, is produced. The mechanical properties and relative wear resistance of the steel obtained are shown in Table 2. Wear resistance of high-manganese steel of Example 1 is accepted for 100%.

EXAMPLE 2

Plain steel is being melted in al electric-arc furnace of 5-t capacity during 100 minutes until metal melt of a certain chemical composition (see Table 1) is obtained. At the same time the alloying additive of the composition shown in Table 1, mainly of manganese, is being melted in a plasma-induction furnace of 1-t capacity. Then nitrogen saturation of the alloying additive being melted is carried out by its treatment with low-temperature plasma, formed of a nitrogen-containing gas at nitrogen partial pressure in it about 0.15 MPa, for example, with a plasma arc of 200–300 kW power glowing between the plasma generator electrode and the melt.

More to that, during nitrogen saturation of the alloying addition being melted, a portion of nitride-forming elements specified by the chemical composition of the steel is introduced into it. In this case it is titanium, A portion of the nitride-forming elements, introduced into the alloying addition saturated with nitrogen is determined by the relationship:

$$\sum_{i=1}^{n} \frac{m_i}{[Me_i]} = \sum_{i=1}^{n} \left( 1 + 283 \frac{\rho^* \delta}{\sqrt{P_{N2}}} \cdot K^i \alpha_N^i \right),$$

where $m_i$ - amount of i-alloying element, %, the quantity sought for;

$[Me_i]$ - the total quantity of i-alloying element according to the chemical composition, 0.10–0.15% of titanium in our example;

$P_{N2}$ - nitrogen partial pressure in plasma-forming gas, for the given example 0.15 MPa;

$\beta$ - coefficient of mass-transfer intensity, for a plasma-induction furnace of 1-t capacity is equal to 0.75;

$\delta$ - criterion of oversaturation with nitrogen, for the given example it is equal to 1.35;

$K^i$ - factor of assimilation of i-alloying addition. For titanium in a plasma-induction furnace is equal to 0.8;

$\alpha_N^i$ - parameter of interaction in liquid melts Mn-N-i at temperature of pouring out.

For titanium it is equal to 0.43 at 1573 K. Putting numerical values into the relationship we have:

$$\frac{m_{Ti}}{0.10\text{–}0.15} = \left\{ 1 + 238 \frac{0.75 \cdot 1.35}{150 \cdot 103} \cdot 0.8(-0.43) \right\} = 0.745$$

It shows that approximately 75% by mass of the total amount of the required titanium should be added into the alloying additive being saturated with nitrogen. Then the both melts - the plain steel and the alloying addition saturated with nitrogen - are mixed in the ladle. To this end the first portion in an amount of about 0.3 of the plain steel melt mass is poured into the ladle, then the melted alloying additive saturated with nitrogen is added to it, and then, the rest of the melted plain steel mass, viz. about 0.7 of the melt mass is poured into the ladle. During mixing of the melts the balance of the nitride-forming elements, determined with the help of the above mentioned relationship is introduced into the ladle. For the given example it is about 25% by mass of the total required amount of titanium. As a result, steel of the required analysis, shown in Table 1, is obtained. The mechanical properties and relative wear resistance of steel produced are shown in Table 2.

EXAMPLE 3

Preparation of plain steel and an alloying addition is carried out in the same way as in Example 2. Only during nitrogen saturation of the alloying additive a portion of titanium, which amount is determined in a way similar to that described in Example 2, is added to the alloying additive after preliminary grinding into particles of 1–4 mm size. The particles of less than 1 mm size are quickly evaporated due to the action of the plasma arc and do not penetrate into the melt, and the particles of more than 4 mm size are heated not enough in the low-temperature plasma during the time of contact with it and assimilated by the melt insufficiently. After mixing, performed as it is described in Example 2, steel of the required analysis, shown in Table 1, is produced. The mechanical properties and relative resistance of the steel produced are shown in Table 2.

EXAMPLE 4

Plain steel is being melted in an electric-arc furnace of 5-t capacity during 100 minutes until the metal of specified composition (see Table 1) is obtained. At the same time an alloying additive of the chemical composition as shown in Table 1, mainly of manganese is being melted in a plasma-induction furnace of 1-t capacity. Then the alloying additive while melting is being saturated with nitrogen through treatment by a low-temperature plasma, formed in nitrogen-containing gas with nitrogen partial pressure in it about 0.1 MPa, for example, with help of a plasma arc of 200–300 kW power, glowing between the plasma generator electrode and the melt. During nitrogen saturation of the alloying addition being melt a portion of nitride-forming elements specified by the steel chemical composition is introduced into it. In this case they are titanium and cerium. The portion of the nitride-forming elements introduced into the alloying addition being saturated with nitrogen is determined by relationship (1), which for the given example is follows:

$$\frac{m_{Ti}}{[Me_{Ti}]} + \frac{m_{Ce}}{[Me_{Ce}]} = \left\{ 1 + 283 \frac{0.75 \cdot 0.3}{\sqrt{10^5}} \cdot 0.8(-43) \right\} + \left\{ 1 + 283 \frac{0.75\ 0.3}{\sqrt{10^5}} \cdot 0.7(-0.31) \right\} = 0.93\text{Ti} + 0.96\text{Ce}$$

It shows that approximately 93% by mass of the total amount of titanium and 96% of cerium should be added into the allowing additive being saturated with nitrogen. Then, the both melts - the plain steel and the alloying addition saturated with nitrogen - are being mixed in a ladle. To this end, to the total mass of the alloying additive saturated with nitrogen it is added the whole mass of the melted plain steel. While their mixing the remaining amount of the nitride-forming elements, i.e. about 7% by mass of the total required amount of titanium and 4% by mass of cerium are introduced into the melt. As a result, steel of the required composition shown in Table 1 is produced. The mechanical properties and relative wear-resistance of the steel produced are shown in Table 2.

TABLE 1

| Number of Example 1 | 2 | Chemical composition C 3 | Mn 4 | Si 5 |
|---|---|---|---|---|
| 1. | Composition of the plain steel | 0.27 | 0.80 | 0.30 |
| | Analysis of the alloying additive | 6.3 | 75.5 | 1.6 |
| | Analysis of the melt | 2.28 | 9.5 | 0.5 |
| 2. | Composition of plain steel | 0.21 | 0.94 | 0.35 |
| | Analysis of the alloying additive | 6.1 | 76 | 1.5 |
| | Analysis of the melt | 1.10 | 13.5 | 0.64 |
| 4. | Composition of plain steel | 0.45 | 2.10 | 0.41 |
| | Analysis of the alloying additive | 5.9 | 76 | 1.5 |

TABLE 1-continued

| | Analysis of the melt | | 1.0 | 9.8 | 0.3 |
|---|---|---|---|---|---|
| No. | % by mass | | | | |
| | S | P | Ti | Ce | N |
| 1 | 6 | 7 | 8 | 9 | 10 |
| 1 | up to 0.03 | up to 0.03 | — | — | — |
| | up to 0.03 | up to 0.40 | 0.28 | — | 0.31 |
| | 0.017 | 0.08 | 0.03 | | 0.05 |
| 2 | up to 0.03 | up to 0.03 | — | — | — |
| 3 | 0.03 | 0.43 | 0.50 | — | 0.54 |
| | 0.026 | 0.09 | 0.12 | — | 0.09 |
| 4 | up to 0.03 | up to 0.03 | — | — | — |
| | 0.03 | 0.41 | 0.20 | 0.50 | 0.20 |
| | 0.015 | 0.07 | 0.04 | 0.07 | 0.03 |

TABLE 2

| | Mechanical properties | | | | | |
|---|---|---|---|---|---|---|
| Example No. | $\sigma_\beta$, MPa | $\sigma_\tau$, MPa | $\delta$, % | $\psi$, % | KVC kJ/sq.m | relative wear resistance, % |
| Example 1 | 680 | 435 | 17 | 17 | 1950 | 100 |
| Example 2 | 875 | 500 | 23 | 24 | 2400 | 51 |
| Example 3 | 880 | 530 | 22 | 24 | 2600 | 65 |
| Example 4 | 950 | 600 | 25 | 27 | 2100 | 78 |

What we claim is:

1. A wear-resistant steel consisting essentially of carbon, manganese, silicon, sulphur, phosphorous, nitrogen, titanium, and iron in the following % by weight:

| | |
|---|---|
| carbon | 0.4–1.3 |
| manganese | 3–11.5 |
| silicon | 0.1–1.0 |
| sulphur | up to 0.05 |
| phosphorus | up to 0.1 |
| titanium | 0.01–0.15 |
| nitrogen | 0.02–0.9 |
| iron | the balance. |

2. The wear-resistant steel according to claim 1, and further consisting essentially of cerium in an amount of 0.0057–0.0839% by weight.

3. The wear-resistant steel according to claim 2, wherein the carbon, manganese, silicon, sulphur, phosphorus, nitrogen, titanium, cerium and iron are in the following % by weight:

| | |
|---|---|
| carbon | 0.4–1.0 |
| manganese | 4–10 |
| silicon | 0.2–1.0 |
| titanium | 0.03–0.1 |
| nitrogen | 0.02–0.6 |
| cerium | 0.005–0.08 |
| sulphur | up to 0.05 |
| phosphorus | up to 0.1 |
| iron | the balance. |

* * * * *